US006146769A

United States Patent [19]

Anton

[11] Patent Number: 6,146,769

[45] **Date of Patent: *Nov. 14, 2000**

[54] INK/TEXTILE COMBINATION HAVING IMPROVED DURABILITY

[75] Inventor: Waifong L. Anton, Wilmington, Del.

[73] Assignee: E. I. du Pont de Nemours and Company, Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 09/001,872

[22] Filed: Dec. 31, 1997

[51] Int. Cl.[7] ..... B32B 27/04; C09D 11/00

[52] U.S. Cl. ..... 428/500; 428/510; 428/514; 428/520; 428/522; 428/196; 428/207; 442/75; 347/96; 347/100; 347/105; 106/31.6; 106/31.85; 106/31.28

[58] Field of Search ..... 106/31.13, 31.28, 106/31.6, 31.85; 442/74, 75; 347/96, 100, 105, 106; 428/196, 206, 207, 361, 365, 375, 411.1, 500, 510, 514, 520, 522, 543

[56] References Cited

U.S. PATENT DOCUMENTS

| | | | |
|---|---|---|---|
| 3,554,987 | 1/1971 | Smith . | |
| 3,924,046 | 12/1975 | Ribka et al. | 428/375 |
| 4,350,788 | 9/1982 | Shimokawa et al. | 524/309 |
| 4,624,985 | 11/1986 | Tsutsumi et al. | 524/803 |
| 4,966,791 | 10/1990 | Kissel et al. | 427/389.9 |
| 5,274,025 | 12/1993 | Stockl et al. | 524/513 |
| 5,856,023 | 1/1999 | Chen et al. | 428/520 |
| 5,891,950 | 4/1999 | Collins et al. | 524/502 |
| 6,037,390 | 3/2000 | Page et al. | 523/160 |
| 6,040,358 | 3/2000 | Page et al. | 523/161 |

*Primary Examiner*—Marie Yamnitzky
*Attorney, Agent, or Firm*—Joseph A. Tessari

[57] ABSTRACT

An ink/textile combination is provided wherein the ink contains an aqueous carrier and a pigment dispersion and the textile contains moieties selected from the group consisting of epoxy, hydroxyl, amine, amido, carboxyl moieties and mixtures thereof; wherein an interactive polymer is present in at least one of the ink or the textile and wherein the interactive polymer has at least one A monomer unit having active methylene groups and at least one B monomer unit selected from the group consisting of acrylates, methacrylates, polymerizable vinyl monomers, vinyl pyrrolidone, acrylamides, methacrylamides, vinyl acetate, vinyl alcohols and combinations thereof.

10 Claims, No Drawings

INK/TEXTILE COMBINATION HAVING IMPROVED DURABILITY

BACKGROUND OF THE INVENTION

This invention relates to an ink and fabric combination in ink jet printing, and more particularly, to an ink/fabric combination that produces more durable, water-fast and wash-fast images.

Dyeing of fabrics with anionic dyes, particularly fabrics containing polyamide fibers is known. Anionic dyes such as acid dyes and pre-metallized dyes are widely used for the dyeing of polyamide fibers in which the nitrogen containing groups of the polyamide fibers such as nylon and hydroxy groups of the cellulose fibers such as cotton, rayon etc. serve as the dye sites.

Conventionally, the dyeing of fabrics involves immersion of the fabric in an aqueous bath containing a solution of the dye after the fabric has been pretreated by treatments well-known in the art. Typically all the dye used in the process is added to the bath prior to immersion of the fabric; that is, the bath is at "full strength" prior to immersion of the fabric. The bath is then typically raised to an elevated temperature, often as high as the boiling point at ordinary atmospheric pressure. At times, dyeing is done at extreme temperatures using autoclaves.

In an alternate process, disclosed in U.S. Pat. No. 5,230,709, the bath containing the fabric is first raised to a temperature characterized as a "transition temperature" for the particular polyamide. The dye solution is then introduced to the bath in aliquots in such a way that the polyamide fibers are kept "hungry" for dye.

The above processes are used for uniform dyeing of the fabric. For dyeing fabrics to produce a pattern, it is known use a screen printing process for the application of the dye.

Dyes which are used in the processes know in the art are often called small molecule "leveling" dyes. Where good light fastness and/or wash fastness are required, large molecule and pre-metallized dyes are more desirable. Yet, these types of dyes have the disadvantage in that they are structure sensitive, meaning that minor variation in the physical structure of the fibers are revealed in the final dyed product. This is undesirable. It is known to use dye auxiliaries and retarding agents to counteract this defect, but the use of such compounds often inhibit the ability of the fibers to be deeply colored or have dark shades.

Another approach to dyeing polyamides and mixed fiber fabrics, such as polyamides and cotton, makes use of fiber reactive dyes. Such reactive dyes form covalent bonds with free amine end groups of the polyamide fraction and covalent bonds with the hydroxyl groups of the cellulose fraction. One class of reactive dyes are the dichloro-s-triazinyl system. These dyes in aqueous solution can be displaced from solution onto the polyamide by addition of salt (e.g., potassium chloride) and then alkali which fixes the dye with the fiber. Another class are the vinyl sulfone reactive dyes based upon sulfate esters of hydroxysulphonyl dyes. Under alkaline conditions the vinyl sulfone group is generated which in turn reacts with ionized cellulose to form the covalent bond between dye and fiber. As disclosed in U.S. Pat. No. 4,762,524; dyeing of polyamides at the boil with vinyl sulfone reactive dyes is also possible under conditions therein disclosed. As a result, it is know to dye polyamide and cotton blends with appropriately chosen fiber reactive dye systems. In particular, better wash fastness and color fastness for deep shades are obtainable with fiber reactive dyes. However, this process is disadvantageous in that it includes wet processing and the proper disposal of the effluent stream containing unreacted dye adds expense and raises environmental concerns.

Attempts have been made recently to reproduce high quality colored graphic or pictorial information using ink jet technologies for applications such as textile printing. Ink jet printing is a non-impact method for recording information in response to an electronic signal, such as that generated by a computer. In the printer, the electronic signal produces droplets of ink that are deposited on a substrate or media such as paper or transparent film. Such attempts have been met with several challenges. For example, it has proved difficult to accurately reproducing the various hues, tints, and colors contained in a typical colored picture on fabric fabrics using ink jet printers. In addition, the images printed on such fabrics are expected to be durable (crock-fast) and to withstand the rigorous treatments of fabrics, such as laundering.

The processes described above for processing of textile fabric or fibers have several processing limitations and the dyes have their own limitations when it is desired to record a high quality, multicolored image. Color selection is limited because many of the readily available dyes lack color fastness (i.e., the dye tends to fade upon exposure to ultraviolet light) or do not have enough solubility to give the required chroma. Moreover, the tendency of ink droplets to wick or bleed together is an aggravated problem because the printing of a high quality image depends on the formation of small, sharply defined dots of each printed color. While some of the problems associated with dye based inks can be overcome or alleviated to some extent, a need still exists for better inks and/or better treatments or coatings for fabrics or fibers that will be ink jet printed. A specific need exists for such an ink/fabric combination that is capable of reproducing colored pictorial information as a high quality, durable, wash-fast and water-fast image on fabric substrates, thereby meeting the requirements for textile printing.

SUMMARY OF THE INVENTION

The present invention provides an ink jet ink/textile combination, comprising: An ink jet ink/textile combination, comprising:

(a) an ink jet ink composition containing an aqueous vehicle and a particulate colorant;

(b) a textile containing moieties selected from the group consisting of epoxy, hydroxyl, amine, amido, carboxyl moieties and mixtures thereof;

(c) wherein at least one of the ink or the textile contains an interactive polymer;

(d) wherein the interactive polymer comprises a water soluble polymer having (1) at least one A monomer unit having active methylene groups and (2) at least one B monomer unit selected from the group consisting of acrylates, methacrylates, polymerizable vinyl monomers, vinyl pyrrolidone, acrylamides, methacrylamides, vinyl acetate, vinyl alcohols and combinations thereof.

The specified polymer may be used in the ink as a dispersant or a binder additive, or may be used as a pretreatment for the fabric. If the polymer is present in the ink, a resin or other reagent may be added to the fabric surface as a pretreatment to accelerate the reaction of the polymer and the groups present on the fabric. An external energy source, such as heat may also be used to accelerate the curing rate.

The ink/textile combination has general utility in printing, particularly in ink-jet printing applications using thermal or bubble jet printers, piezoelectric printers, continuous flow printers, air brush printers or valve jet printers.

DETAILED DESCRIPTION OF THE INVENTION

The present invention provides an ink jet ink/textile combination which provides printed images having improved durability (crock fastness), wash-fastness and water-fastness.

Ink Jet Ink

The ink jet ink comprises an aqueous vehicle and a particulate colorant. The ink may also contain other additives known in the art.

Aqueous vehicle: The aqueous vehicle is water or a mixture of water and at least one water-soluble organic solvent. Selection of a suitable mixture depends on requirements of the specific application, such as desired surface tension and viscosity, the selected colorant, drying time of the ink, and the type of substrate onto which the ink will be printed. Representative examples of water-soluble organic solvents that may be selected are disclosed in U.S. Pat. No. 5,085,698. A mixture of water and a polyhydric alcohol, such as diethylene glycol, is preferred as the aqueous vehicle.

If a mixture of water and a water-soluble solvent is used, the aqueous vehicle typically will contain 30% to about 95% water with the balance (i.e., 70 to 5%) being the water-soluble solvent. Preferred compositions contain approximately 60% to 95% water, based on the total weight of the aqueous vehicle.

The amount of aqueous vehicle in the ink is in the range of approximately 70 to 99.8%, preferably 80 to 99.8%, based on total weight of the ink when an organic pigment is selected and approximately 25 to 99.8%, preferably 70 to 99.8% when an inorganic pigment is selected.

Particulate Colorant: The colorant is either a disperse dye or a pigment that is insoluble in the aqueous vehicle. By "pigment" we mean a colorant that is insoluble (i.e., in particulate or crystalline form) throughout the printing process. "Dispersed dyes" are colorants that, while insoluble in the aqueous vehicle, become soluble at some point in the printing process. Pigments are the preferred colorants for use in the ink compositions of this invention.

Pigments: Useful pigments comprise a wide variety of organic and inorganic pigments, alone or in combination. The pigment particles are sufficiently small to permit free flow of the ink through the ink jet printing device, especially at the ejecting nozzles that usually have a diameter ranging from 10 microns to 50 microns. The particle size also has an influence on the pigment dispersion stability, which is critical throughout the life of the ink. Brownian motion of minute particles will help prevent the particles from settling. It is also desirable to use small particles for maximum color strength. The range of useful particle size is approximately 0.005 micron to 15 microns, preferably 0.005 to 5 microns, and most preferably from 0.01 to 0.3 micron. Representative commercial dry and presscake pigments that may be used in practicing the invention are disclosed in U.S. Pat. No. 5,085,698.

In the case of organic pigments, the ink may contain up to approximately 30% pigment by weight, but will generally be in the range of approximately 1 to 15%, preferably approximately 1 to 8%, by weight of the total ink composition for most ink jet printing applications. If an inorganic pigment is selected, the ink will tend to contain higher weight percentages of the pigment than with comparable inks employing organic pigment, and may be as high as approximately 50%, because inorganic pigments generally have a higher specific gravity.

Disperse Dyes: The color and amount of dye present in the ink composition is largely a function of choice, being primarily dependent upon the desired color of the print achieved with the ink, the purity of the dye and its strength. Low concentrations of dye may not give adequate color vividness whereas high concentrations may result in poor printhead performance or unacceptably dark colors. Generally, the disperse dye will be present in the amount of 0.01 to 20%, preferably 0.05 to 8%, and most preferably 1 to 5%, by weight, based on the total weight of the ink composition. Disperse dyes that may be useful in this invention are known to those in the art and are disclosed in U.S. Pat. No. 5,053,495; U.S. Pat. No. 5,203,912; and U.S. Pat. No. 5,102,448; all of which are incorporated herein by reference.

Dispersant: The dispersant is preferably a polymeric dispersant. Either structured or random polymers may be used, although structured polymers are preferred for use as dispersants for reasons well known in the art. The term "structured polymer" means polymers having a block, branched or graft structure. Particularly preferred structured polymers are AB or BAB block copolymers disclosed in U.S. Pat. No. 5,085,698; ABC block copolymers disclosed in European Patent Application 0 556 649 A1; and graft polymers disclosed in U.S. Pat. No. 5,231,131. The disclosure of each of these references is incorporated herein by reference.

Polymers dispersants suitable for use in the present invention comprise both hydrophobic and hydrophilic monomers. Some examples of hydrophobic monomers used in random polymers are methyl methacrylate, n-butyl methacrylate, 2-ethylhexyl methacrylate, benzyl methacrylate, 2-phenylethyl methacrylate and the corresponding acrylates. Examples of hydrophilic monomers are methacrylic acid, acrylic acid, dimethylaminoethyl[meth]acrylate and salts thereof. Also quaternary salts of dimethylaminoethyl[meth]acrylate may be employed.

The number average molecular weight of the polymer must be less than 50,000 Daltons, preferably less than 10,000 and most preferably less than 6,000. Polymers having a polydispersity (the relationship between number average molecular weight and weight average molecular weight) between 1–4, most preferably between 1–2 are most advantageous.

In an alternative embodiment, the interactive polymer described below may be used as the pigment dispersant in lieu of the dispersants described above.

Other Ingredients: The ink jet ink may contain other ingredients as are well known in the art. For example, anionic, nonionic, or amphoteric surfactants may be used. Cationic surfactants may be used as long as careful consideration is given to compatibility with the other ink components. In aqueous inks, the surfactants may be present in the amount of 0.01–5% and preferably 0.2–2%, based on the total weight of the ink. Cosolvents may be included to improve penetration and pluggage inhibition properties of the ink composition, such as those exemplified in U.S. Pat. No. 5,272,201. Biocides may be used to inhibit growth of microorganisms. Sequestering agents such as EDTA may also be included to eliminate deleterious effects of heavy metal impurities. Other known additives may also be added to improve various properties of the ink compositions as desired.

Ink Properties Jet velocity, separation length of the droplets, drop size and stream stability are greatly affected by the surface tension and the viscosity of the ink. Pigmented ink jet inks suitable for use with ink jet printing systems should have a surface tension in the range of about 20 dyne/cm to about 70 dyne/cm and, more preferably, in the range 30 dyne/cm to about 70 dyne/cm at 20° C. Acceptable viscosity is no greater than 20 cP, and preferably in the range of about 1.0 cP to about 10.0 cP at 20° C. The ink has physical properties compatible with a wide range of ejecting conditions, i.e., driving voltage and pulse width for thermal ink jet printing devices, driving frequency of the piezo element for either a drop-on-demand device or a continuous device, and the shape and size of the nozzle. The inks have excellent storage stability for a long period and do not clog in an ink jet apparatus. Further, the ink does not corrode parts of the ink jet printing device it comes in contact with, and it is essentially odorless and non-toxic.

Textile

Textiles useful in this invention include those containing epoxy, hydroxy, amine, amido or carboxyl groups, protein-like fibers, polypropylene, polyacrylonitrile, cellulose triacetate and mixtures thereof.

Some examples of hydroxyl group containing textiles include cellulose containing fibers such as viscose staple and cotton and fibers containing fibrion hydroxy polymers. Suitable amine or amido group containing fibers include wool, synthetic polyamides and silk. Polyamide fibers include those spun from diamine-diacid polymers: nylon 6,6; nylon 6,12; nylon 6,10; and nylon 4,6. Fibers spun from polymers derived from cyclic lactam monomers or omega-aminocarboxylic acids: nylon 6, nylon 7, nylon 11, nylon 12; and fibers spun from copolyamides of notably nylon 6,6 or nylon 6 are also included. Some examples of carboxy group containing textile include, but are not limited to, polyester fibers such as those based on polybutylene terephthalate, poly-1,4-cyclohexylene dimethylene terephthalate, but in particular polyethylene terephthalate, which may have been modified, for example, with the view to easier printability, by co-condensing them with other components such as other dicarboxylic acids and other diols.

The finished form of the textile used to practice this invention includes, but is not limited to, fibers, yams, fabrics, non-woven webs and garments as well as furnishings like carpets and upholstery fabrics.

Interactive Polymer: The interactive polymer is a soluble polymer and comprises at least one A monomer unit and at least one B monomer unit. Monomer unit A contains active methylene groups that provide good adhesion of the polymer to the fabric through interaction with any of the epoxy, hydroxy-, carboxylic- or amino-moieties of the fabric.

Active methylene groups are methylene groups between two activating groups such as carbonyl. Such methylene groups exhibit unusual chemical activity and are said to be "active". Malonic esters, acetoacetic esters, cyanoacetic esters and 1,3-diketones are examples of compounds containing such groups. In preferred embodiments, the active methylene groups are usually separated from the main polymer chain by at least three carbon atoms and can be introduced into the side chains of a polymer by copolymerizing a monomer containing at least one active methylene group, for example, a

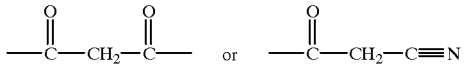

group, and independently polymerizable unsaturated methylene group with at least one other copolymerizable monomer containing, for example, at least one —CH═C— or $CH_2$═C— group. A particularly effective method of preparation is through the use of acrylic type esters having active methylene groups in the ester moiety or in a substituent alpha to the carbonyl group. Such compounds can be represented by the formula:

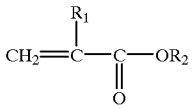

wherein $R_1$ is hydrogen, alkyl or Y; $R_2$ is alkyl, cycloalkyl, aryl or Y, provided that one and only one of $R_1$ and $R_2$ is Y, and Y is

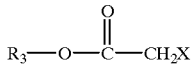

wherein $R_3$ is alkylene and X is aliphatic acyl or cyano.

Monomer unit A is present in amount of 5–80% by weight, based on the total weight of the polymer.

Monomer unit B is derived from any combination of acrylates, methacrylates, polymerizable vinyl monomers, vinyl pyrrolidone, acrylamides, methacrylamides, vinyl acetate and vinyl alcohols that provide significant bulk/substance to encapsulate the insoluble pigment or dispersed dyes. Some specific examples of these types of monomers include methyl acrylate, ethyl acrylate, butyl acrylate, propyl acrylate, isobutyl acrylate, hexyl 2-ethyl acrylate, hexyl acrylate, nonyl acrylate, lauryl acrylate, isobornyl acrylate, benzyl acrylate, methyl methacrylate, ethyl methacrylate, butyl methacrylate, propyl methacrylate, isobutyl methacrylate, hexyl 2-ethyl methacrylate, hexyl methacrylate, nonyl methacrylate, lauryl methacrylate, isobornyl methacrylate or benzyl methacrylate; polymerizable vinyl aromatic monomers such styrene, a-methyl styrene, vinyl toluene, etc.; vinyl pyrrolidone, methacrylamides and any combinations of the above monomers.

Monomer unit B may be neutralized to provide solubility to the polymer by use of neutralization agents. Some suitable neutralization agents include inorganic bases such as potassium hydroxide, sodium hydroxide; organic amines such as ammonia, aminopropanol, triethylamine, diethylmethyl ethanolamine, ethanolamine, etc; hydrochloric acids, nitric acids, phosphoric acids, sulfuric acids, para-toluenesulfonic acids, citric acids, glycolic acids, etc. Monomer unit B is present in the amount of 15–90% by weight, based on the total weight of the polymer.

Optionally, monomer unit C may be present if monomers A and B result in an insoluble polymer. Monomer unit C has acid-segments or amine-segments that, upon neutralization with appropriate agents, render the polymer soluble in water. Some examples of acid-segments include carboxylate, sulfonate groups, acrylic acid, methacrylic acid, acrylamidomethylpropane sulfonic acid and benzene sulfonic acid. Some suitable neutralization agents include inorganic bases such as potassium hydroxide, sodium hydroxide, organic amines such as ammonia, aminopropanol, triethylamine, diethylmethyl ethanolamine, ethanolamine, etc. Some suitable amine-segments include dialkylamino groups, 2-dimethylaminoethyl methacrylate, 2-dimethylaminoethylacrylate, 2-diethylaminoethylacrylate, 2-diethylaminoethylmethacrylate. Some suitable neutralization agents can be phosphoric acids, sulfuric, para-toluenesulfonic acids, citric acids, glycolic acids, etc. Alternatively, the amine functionalities can be rendered water soluble by quaternization with reagents such as benzyl chloride, dimethyl sulfate, methyl chloride, etc. The C segment may be present in the polymer in the amount of 2–85% by weight, based on the total weight of the polymer.

When applied to as a pre-treatment to the fabric, the polymer may be applied alone, or together with other resins or reagents. Likewise, if the polymer is used in the ink (as a binder or dispersant), the fabric may be untreated or may be treated with resins or other reagents prior to printing. Some examples of other resins for fabric treatment include amine-containing copolymers (such as Jeffamines® from Huntsman Petrochemical.), epoxy-containing copolymers, aldehyde-containing copolymers. Some examples of other reagents include salts, metals, acids or alkali for optimum product performance.

Applications

The ink is applied to the textile using conventional ink jet printing equipment, such as thermal or bubble jet printers, piezoelectric printers, continuous flow printers, air brush or valve jet printers. After the ink is printed on the textile, the printed textile is air dried. Optionally, the printed textile can then be exposed to an external energy source, such as heat.

EXAMPLES

Dispersant

A 12-liter flask was equipped with a mechanical stirrer, thermometer, nitrogen inlet, drying tube outlet, and addition funnels. Tetrahydrofuran, 4750 g, was charged to the flask. The catalyst tetrabutyl ammonium m-chlorobenzoate, 2 ml of a 1M solution in acetonitrile, was then added. Initiator, 1-methoxy-1-trimethylsiloxy-2-methyl propene, 155 g was injected. Feed 1,2-dimethylaminoethyl methacrylate, 2801 g and ethyl triethyleneglycol methacrylate, 657 g, was added over 45 minutes. One hundred minutes after Feed I was completed Feed II, benzyl methacrylate, 1568 g, was added over 30 minutes. At 400 minutes, 300 g of methanol was added to the above solution and distillation begins. A total of 1725 g of volatile was removed. Iso-propanol, 1790 g, was added after completion of the distillation.

Magenta Concentrate

A pigment chip was made by mixing together 200 g of Dispersant, 150 g of Quinacridone R-122 pigment (Sun Chemical Corp., Cincinnati, Ohio) and 450 g of isopropanol and charging the mixture to a 2-roll mill and processing for 45 minutes. An aqueous 15% pigment concentrate was then prepared by mixing 143 g of the chip with 33 g of p-toluenesulfonic acid and 396 g of deionized water.

Yellow Concentrate

A yellow pigment concentrate was prepared according to the procedure described above except that Yellow Pigment Y128 (Sun Chemical Corp. Cincinnati, Ohio.) was used in place of the magenta pigment.

Cyan Concentrate

A cyan pigment concentrate was prepared according to the procedure described above except that Pigment Blue D7072DD (BASF) was used in place of the yellow pigment.

Yellow Concentrate 2

A yellow pigment concentrate was prepared according to the procedure described above except Yellow Pigment Y17 (Sun Chemical Corp. Cincinnati, Ohio.) was used in place of the cyan pigment.

Interactive Polymer: n-butylmethacrylate-co-2-acetoacetoxy ethylmethacrylate-co-dimethylaminoethyl methacrylate.

A reactor equipped with a mechanical stirrer, thermometer and addition funnels was charged with ethyl acetate, 117 g. The contents of the pot was brought to reflux. Feed 1 (n-butyl methacrylate, 150 g; 2-(acetoacetoxy)ethyl methacrylate, 50 g; and dimethylaminoethyl methacrylate, 50 g) was added over 60 min. A solution of 2,2'-azobis(2,4-dimethylvaleronitrile), 2.5 g in ethyl acetate, 50 g; was added over 400 min. to the pot. The mixture was refluxed for another 30 min. and then allowed to cool to room temperature. The resultant polymer is of weight average molecular weight of approximately 85,000. Phosphoric acid of 85% concentration, 33 g, and deionized water, 2050 g, were added to make an aqueous solution of 10% concentration of the polymer.

Ink 1

A magenta ink was prepared by mixing the following ingredients together with stirring:

| Ingredient | Amount (g) |
|---|---|
| Magenta Concentrate | 13.5 |
| Interactive Polymer | 10.0 |
| triethylene glycol | 5.0 |
| 2-pyrrolidone | 4.0 |
| tetraglyme; | 5.0 |
| Multranol ® 4012 from Bayer Corp., Pittsburgh, PA. | 2.5 |
| tripropylene glycol monomethyl ether | 4.0 |
| Tergitol 15-s-7 from Union Carbide Co., Danbury, CT. | 1.0 |
| deionized water | 55.0 |

Ink 2

A yellow ink was prepared by combining the following with adequate mixing:

| Ingredient | Amount (g) |
|---|---|
| Yellow Concentrate | 23.5 |
| Interactive Polymer | 10.0 |
| triethylene glycol | 5.0 |
| tetraglyme | 5.0 |
| 2-pyrrolidone | 4.0 |
| Multranol ® 4012 | 2.5 |
| tripropylene glycol monomethyl ether | 4.0 |
| Tergitol 15-s-7 | 1.0 |
| Deionized water | 45.0 |

Ink 3

A cyan ink was prepared by combining the following with adequate mixing:

| Ingredient | Amount (g) |
|---|---|
| Cyan Concentrate | 13.5 |
| Interactive Polymer | 30.0 |
| triethylene glycol | 5.0 |

-continued

| Ingredient | Amount (g) |
|---|---|
| tetraglyme | 5.0 |
| 2-pyrrolidone | 4.0 |
| Multranol ® 4012 | 2.5 |
| tripropylene glycol monomethyl ether | 4.0 |
| Tergitol 15-s-7 | 1.0 |
| Deionized water | 35.0 |

Ink 4

A magenta ink was prepared by combining the following with adequate mixing.

| Ingredient | Amount (g) |
|---|---|
| Magenta Concentrate | 9.5 |
| Interactive Polymer | 15.0 |
| triethylene glycol | 2.5 |
| 2-pyrrolidone | 2.0 |
| Multranol ® 4012 | 1.3 |
| tripropylene glycol monomethyl ether | 2.0 |
| Tergitol 15-s-7 | 0.5 |
| Deionized water | 14.8 |

Ink 5

A yellow ink was prepared by combining the following with adequate mixing:

| Ingredient | Amount (g) |
|---|---|
| Yellow Concentrate 2 | 6.5 |
| Interactive Polymer | 10.0 |
| triethylene glycol | 2.5 |
| 2-pyrrolidone | 2.0 |
| Multranol ® 4012 | 1.3 |
| tripropylene glycol monomethyl ether | 2.0 |
| Tergitol 15-s-7 | 0.5 |
| Deionized water | 22.2 |

Ink 6

A cyan ink was prepared by combining the following with adequate mixing.

| Ingredient | Amount (g) |
|---|---|
| Cyan Concentrate | 6.5 |
| Interactive Polymer | 10. |
| triethylene glycol | 2.5 |
| 2-pyrrolidone | 2.0 |
| Multranol ® 4012 | 1.3 |
| tripropylene glycol monomethyl ether | 2.0 |
| Tergitol 15-s-7 | 0.5 |
| Deionized water | 22.2 |

Comparative Ink A

A magenta ink was prepared as in Ink 1, except that no Interactive Polymer was used and an additional 10 grams of deionized water (total of 65 g) was added.

Comparative Ink B

A yellow ink was prepared as in Ink 2, except that instead of 10 g of Interactive Polymer, an additional 20 g of deionized water (65 g total) was used.

Comparative Ink C

A cyan ink was prepared as in Ink 3, except that no Interactive Polymer was used and the ink contained a total of 65 g of deionized water.

Comparative Ink D

A magenta ink was prepared as in Ink 4, except that no Interactive Polymer was used and the ink contained a total of 29.2 g of deionized water.

Comparative Ink E

A yellow ink was prepared as in Ink 6, except that the ink contained no Interactive Polymer and contained a total of 32.2 g of deionized water.

Comparative Ink F

A cyan ink was prepared according to the procedure for Comparative Ink E, except 6.5 g of the cyan concentrate was used in place of the yellow concentrate 2.

Test Substrates

The substrates used for printing were obtained from TestFabrics Inc., Middlesex, N.J. They include bleached tubular cotton T-shirt materials of 124 g per sq. de Chine of 72 g per sq. meter; white nylon and 70/30 cotton-polyester blend fabric.

Images consisting of ⅜ inch×3 inch (0.94 cm×7.63 cm) strips of solid areas of either yellow, cyan, or magenta were obtained. The optical density of these areas were measured using an X-Rite® 418 densitometer (X-Rite Inc., Grandville, Mich.) at 1 hour after printing and also after testing.

The Lab values for the colors were recorded on a Colortron II (Light Source, San Rafael, Calif.) for the image before and after washing. The difference in color (Delta E) is the difference in L, a, b values between the washed and unwashed sample as described by the following equation.

$$\text{Delta } E = SQRT[(L_1-L_2)^2+(a_1-a_2)^2+(b_1-b_2)^2]$$

Example 1

Inks 1, 2 and 3 and Comparative Inks A, B and C were printed out of a DeskJet 1200c (Hewlett Packard, Palo Alto, Calif.) onto 8.5 inch×11 inch (21.6 cm×27.9 cm) pieces of silk, nylon and 70/30 polyester-cotton blend. The fabrics were taped onto pieces of paper which provides stiffness to feed through the printers.

The printed fabrics were air-dried at room temperature and each was subjected to washfastness testing. The washfastness testing involve vigorous agitation for 30 min. of a strip of ½ inch×3 inch (1.3 cm×7.6 cm) pieces of the printed images in 100 g of 5% Tide detergent solution in water. At the end of the 30 minute of agitation, the samples were removed from the detergent solution, rinsed with cold water and air dried.

The degree of durability towards washfastness was indicated by the amount of color (measured by optical density) remaining on the washed sample as compared to the unwashed, printed sample and are shown in Table 1.

TABLE 1

| | | Optical Density | | |
|---|---|---|---|---|
| Substrate | Ink | Before | After | % Retention |
| Silk | 1 | 0.53 | 0.47 | 89 |
| | A | 0.52 | 0.37 | 71 |

TABLE 1-continued

| Substrate | Ink | Optical Density Before | After | % Retention |
|---|---|---|---|---|
| 70/30 Polyester/Cotton Blend | 1 | 0.53 | 0.49 | 92 |
| | A | 0.53 | 0.46 | 87 |
| Nylon | 1 | 0.62 | 0.56 | 90 |
| | A | 0.62 | 0.38 | 61 |
| Silk | 2 | 0.61 | 0.05 | 8 |
| | B | 0.58 | 0.0 | 0 |
| 70/30 Polyester/Cotton blend | 2 | 0.58 | 0.45 | 78 |
| | B | 0.55 | 0.34 | 62 |
| Nylon | 2 | 0.63 | 0.38 | 60 |
| | B | 0.60 | 0.28 | 47 |
| Silk | 3 | 0.73 | 0.53 | 73 |
| | C | 0.70 | 0.15 | 21 |
| 70/30 Polyester/Cotton blend | 3 | 0.70 | 0.58 | 83 |
| | C | 0.65 | 0.49 | 75 |
| Nylon | 3 | 0.69 | 0.49 | 71 |
| | C | 0.79 | 0.57 | 72 |

Example 2

Samples printed with Ink 2 and Comparative Ink B were allowed to cure at ambient temperatures for 5 days. After that time, the washfastness of the images were determined as per procedure described in Example 1. The results are shown in Table 2.

TABLE 2

| Substrate | Ink | Optical Density Before | After | % Retention |
|---|---|---|---|---|
| Silk | 2 | 0.55 | 0.28 | 51 |
| | B | 0.53 | 0.04 | 8 |
| 70/30 Polyester/Cotton Blend | 2 | 0.55 | 0.44 | 80 |
| | B | 0.50 | 0.34 | 68 |
| Nylon | 2 | 0.55 | 0.42 | 76 |
| | B | 0.53 | 0.26 | 49 |

Example 3

Inks 4, 5 and 6 and Comparative Inks D, E and F were printed out of a DeskJet 560c (Hewlett Packard Co.) on to sheets of 8.5 inch×11 inch (21.6 cm×27.9 cm) of bleached, desized mercerized cotton print cloth. All fabrics were taped on to paper to feed through the printer. After printing, the printed fabrics were dried for 15 minutes in a 150° C. oven.

Washing test was performed in accordance to standardized test Method 61-1A, 1996 of American Association of Textile Chemists and Colorists, (Research Triangle Park, N.C.).

The colors were recorded on a Colortron II for the image before and after washing are shown in Table 3.

TABLE 3

| Ink | Before Wash | | | After Wash | | | Delta |
|---|---|---|---|---|---|---|---|
| Example | L | a | b | L | a | b | E |
| 4 | 59 | 47 | −13 | 59 | 47 | −14 | 1.2 |
| D | 56 | 47 | −13 | 64 | 43 | −16 | 9.4 |
| 5 | 89 | −12 | 70 | 89 | −12 | 70 | 0.4 |
| E | 92 | −13 | 67 | 92 | −13 | 66 | 1.3 |
| 6 | 61 | −16 | −35 | 64 | −17 | −34 | 3.6 |
| F | 61 | −17 | −34 | 68 | −19 | −31 | 8.0 |

Example 4

Inks 4, 5 and 6 and comparative inks D, E and F were printed as described in Example 3 except that the sheets bleached, desized mercerized cotton print cloth had previously been dipped in 5% aqueous solution of Tyzor-131 (DuPont Co., Wilmington, Del.) and air-dried. All fabrics were then taped on to paper to feed through the printer. After printing, the printed fabrics were dried, washed and colors recorded as in Example 3. Results are shown in Table 4.

TABLE 4

| Ink | Before Wash | | | After Wash | | | Delta |
|---|---|---|---|---|---|---|---|
| Example | L | a | b | L | a | b | E |
| 4 | 56 | 48 | −13 | 55 | 49 | −14 | 1.2 |
| D | 55 | 52 | −13 | 60 | 49 | −16 | 6.4 |
| 5 | 88 | −11 | 68 | 89 | −11 | 67 | 1.9 |
| E | 90 | −12 | 68 | 91 | −13 | 57 | 11.4 |
| 6 | 63 | −16 | −33 | 65 | −16 | −33 | 2.1 |
| F | 63 | −17 | −34 | 84 | −12 | −13 | 30.5 |

Example 5

Inks 4, 5 and 6 were printed as described in Example 3 except that the cloth had previously been dipped in 5% aqueous solution of Jeffamine® 900 (Huntsman Petrochemical, Houston, Tex.), air-dried and dipped in 5% aqueous solution of potassium hydroxide and then air-dried again. All fabrics were then taped on to paper for stiffness to feed through the printer. After printing, the fabrics were dried, wash tested and the colors recorded as in Example 3. Results are shown in Table 5.

TABLE 5

| Ink | Before Wash | | | After Wash | | | Delta |
|---|---|---|---|---|---|---|---|
| Example | L | a | b | L | a | b | E |
| 4 | 60 | 44 | −15 | 60 | 44 | −17 | 2.2 |
| 5 | 88 | −13 | 66 | 88 | −13 | 64 | 2.1 |
| 6 | 61 | −20 | −36 | 63 | −19 | −35 | 2.1 |

What is claimed is:

1. An ink jet ink composition, comprising:

(a) an aqueous vehicle;

(b) a pigment dispersion comprising a pigment and a polymeric dispersant; and (c) an interactive polymer which is a polymer that is water-soluble in an unreacted form and comprises (1) at least one A monomer unit having at least one active methylene group and (2) at least one B monomer unit selected from the group consisting of acrylates, methacrylates, polymerizable vinyl monomers, vinyl pyrrolidone, acrylamides, methacrylamides, vinyl acetate, vinyl alcohols and combinations thereof;

(d) wherein the ink jet ink composition has a viscosity of no greater than 20 cP at 20° C. and a surface tension of 20 dyne/cm to 70 dyne/cm at 20° C.

2. The ink of claim 1 wherein the active methylene group is separated from the main polymer chain by at least three carbon atoms.

3. The ink of claim 1 wherein the interactive polymer is prepared from monomers represented by the formula:

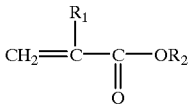

wherein $R_1$ is hydrogen, alkyl or Y, $R_2$ is alkyl, cycloalkyl, aryl or Y, provided that one and only one of $R_1$ and $R_2$ is always Y, and Y is

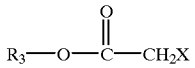

wherein $R_3$ is alkylene and X is aliphatic acyl or cyano.

4. The ink of claim 1 wherein the A monomer unit is present in an amount of 5–80% by weight, based on the total weight of the polymer.

5. The ink of claim 1 wherein the B monomer unit is selected from the group consisting of alkyl acrylate, aryl acrylate, alkylaryl acrylate, alkyl methacrylate, aryl methacrylate, alkylaryl methacrylate, wherein the alkyl group has 1 to 12 carbon atoms and the aryl group has 6 to 12 carbon atoms; polymerizable vinyl aromatic monomers; vinyl pyrrolidone, methacrylamides and combinations thereof.

6. The ink of claim 1, wherein the interactive polymer is neutralized with a neutralization agent selected from the group consisting of inorganic base, organic amines, hydrochloric acids, nitric acids, phosphoric acids, sulfuric acids, p-toluenesulfonic acids, citric acids and glycolic acids.

7. The ink of claim 1, wherein the B monomer unit is present in the amount of 15–90% by weight, based on the total weight of the polymer.

8. An ink jet ink/textile combination, comprising:

(a) an ink jet ink composition containing an aqueous vehicle and a pigment dispersion;

(b) a textile containing moieties selected from the group consisting of epoxy, hydroxyl, amine, amido, carboxyl moieties and mixtures thereof;

(c) wherein the combination further comprises an interactive polymer;

(d) wherein the interactive polymer is a polymer that is water-soluble in an unreacted form and comprises (1) at least one A monomer unit having at least one active methylene group and (2) at least one B monomer unit selected from the group consisting of acrylates, methacrylates, polymerizable vinyl monomers, vinyl pyrrolidone, acrylamides, methacrylamides, vinyl acetate, vinyl alcohols and combinations thereof;

(3) wherein the active methylene group is separated from the main polymer chain by at least three carbon atoms.

9. An ink jet ink/textile combination, comprising:

(a) an ink jet ink composition containing an aqueous vehicle and a pigment dispersion;

(b) a textile containing moieties selected from the group consisting of epoxy, hydroxyl, amine, amido, carboxyl moieties and mixtures thereof;

(c) wherein the combination further comprises an interactive polymer;

(d) wherein the interactive polymer is a polymer that is water-soluble in an unreacted form and comprises (1) at least one A monomer unit having at least one active methylene group and (2) at least one B monomer unit selected from the group consisting of acrylates, methacrylates, polymerizable vinyl monomers, vinyl pyrrolidone, acrylamides, methacrylamides, vinyl acetate, vinyl alcohols and combinations thereof;

(3) wherein the interactive polymer is prepared from monomers represented by the formula:

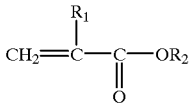

wherein $R_1$ is hydrogen, alkyl or Y, $R_2$ is alkyl, cycloalkyl, aryl or Y, provided that one and only one of $R_1$ and $R_2$ is always Y, and Y is

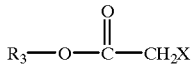

wherein $R_3$ is alkylene and X is aliphatic acyl or cyano.

10. An ink jet ink/textile combination, comprising:

(a) an ink jet ink composition containing an aqueous vehicle and a pigment dispersion;

(b) a textile containing moieties selected from the group consisting of epoxy, hydroxyl, amine, amido, carboxyl moieties and mixtures thereof;

(c) wherein the combination further comprises an interactive polymer;

(d) wherein the interactive polymer is a polymer that is water-soluble in an unreacted form and comprises (1) at least one A monomer unit having at least one active methylene group and (2) at least one B monomer unit selected from the group consisting of acrylates, methacrylates, polymerizable vinyl monomers, vinyl pyrrolidone, acrylamides, methacrylamides, vinyl acetate, vinyl alcohols and combinations thereof;

(3) wherein the interactive polymer is neutralized with a neutralization agent selected from the group consisting of inorganic bases, organic amines, hydrochloric acids, nitric acids, phosphoric acids, sulfuric acids, p-toluenesulfonic acids, citric acids and glycolic acids.

* * * * *